US008267659B2

(12) United States Patent
Ahmad et al.

(10) Patent No.: US 8,267,659 B2
(45) Date of Patent: Sep. 18, 2012

(54) TURBINE BLADE

(75) Inventors: Fathi Ahmad, Kaarst (DE); Scarlett Fajardo-Reina, Ratingen (DE); Markus Gill, Ibbenbüren (DE); Stefan Werner Kiliani, Essen (DE); Silvio-Ulrich Martin, Oberhausen (DE); Ralf Müsgen, Essen (DE); Oliver Schneider, Wesel (DE)

(73) Assignee: Siemens Aktiengesellschaft, München (DE)

( * ) Notice: Subject to any disclaimer, the term of this patent is extended or adjusted under 35 U.S.C. 154(b) by 492 days.

(21) Appl. No.: 12/525,156

(22) PCT Filed: Jan. 14, 2008

(86) PCT No.: PCT/EP2008/050325

§ 371 (c)(1),
(2), (4) Date: Jul. 30, 2009

(87) PCT Pub. No.: WO2008/092725

PCT Pub. Date: Aug. 7, 2008

(65) Prior Publication Data

US 2009/0324421 A1 Dec. 31, 2009

(30) Foreign Application Priority Data

Feb. 1, 2007 (EP) ..... 07002215

(51) Int. Cl.
*F01D 5/18* (2006.01)

(52) U.S. Cl. ..... 416/97 R; 416/229 A; 29/889.721

(58) Field of Classification Search ..... 416/96 R, 416/97 R, 229 R, 229 A; 29/889.7, 889.721, 29/525.13, 525.14

See application file for complete search history.

(56) References Cited

U.S. PATENT DOCUMENTS

| | | | | |
|---|---|---|---|---|
| 2,642,263 | A | 6/1953 | Thorp | |
| 2,801,073 | A | 7/1957 | Savage | |
| 2,906,495 | A | 9/1959 | Schum | |
| 3,806,276 | A * | 4/1974 | Aspinwall | 416/97 R |
| 5,328,331 | A * | 7/1994 | Bunker et al. | 416/96 R |
| 5,533,864 | A * | 7/1996 | Nomoto et al. | 416/96 A |
| 6,238,182 | B1 * | 5/2001 | Mayer | 416/96 A |
| 6,582,194 | B1 * | 6/2003 | Birkner et al. | 416/97 R |

FOREIGN PATENT DOCUMENTS

| | | | |
|---|---|---|---|
| EP | 0974735 | A2 | 1/2000 |
| JP | 2000130760 | A | 5/2000 |
| JP | 2002303155 | A | 10/2002 |
| RU | 2154169 | C2 | 8/2000 |
| SU | 294016 | | 1/1970 |

OTHER PUBLICATIONS

Communication from Russian Patent Office stating cited reference, Dec. 3, 2010, pp. 1-2.

* cited by examiner

*Primary Examiner* — Edward Look
*Assistant Examiner* — Christopher R Legendre

(57) ABSTRACT

A turbine blade is provided. The turbine blade includes a support structure and a shell which surrounds the support structure and which is connected to and at a distance from the support structure by at least one spacing element. For example the spacing element can be a solder globule in order to form a space through which a cooling medium can flow between the support structure and the shell. A method for the production of a turbine blade having a support structure and a shell which surrounds the support structure and which is connected to and at a distance from the support structure is also provided. The shell is soldered to the support structure in at least at one place of the support structure in order to connect the shell to and at a distance from the support structure.

9 Claims, 1 Drawing Sheet

TURBINE BLADE

CROSS REFERENCE TO RELATED APPLICATIONS

This application is the US National Stage of International Application No. PCT/EP2008/050325, filed Jan. 14, 2008 and claims the benefit thereof. The International Application claims the benefits of European Patent Office application No. 07002215.7 EP filed Feb. 1, 2007, both of the applications are incorporated by reference herein in their entirety.

FIELD OF INVENTION

The invention refers to a turbine blade according to the claims and to a method for producing a turbine blade according to the claims.

BACKGROUND OF INVENTION

Turbine blades, especially turbine blades for gas turbines, during operation are exposed to high temperatures which possibly also exceed the limit of the material stress. This especially applies to the regions in the vicinity of the flow inlet edge of the turbine blades. In order to be able to use turbine blades even at high temperatures it has already been known for a long time to suitably cool turbine blades so that they have a higher resistance to temperature, wherein the importance of blade cooling constantly increases especially in the case of gas turbines on account of the increasing gas-turbine inlet temperatures. With turbine blades which have a higher resistance to temperature, higher energy efficiencies in particular can be achieved.

Known types of cooling are inter alia convection cooling, impingement cooling and film cooling. In the case of convection cooling, it is probably the most widespread type of blade cooling. With this type of cooling, cooling air is guided through passages inside the blade and the convective effect used to dissipate the heat. In the case of impingement cooling, a cooling air flow from inside impinges upon the surface of the blade. In this way, a very good cooling effect is made possible at the point of impingement, which is limited, however, only to the narrow region of the impingement point and the immediate vicinity. This type of cooling is therefore mostly used for cooling the flow inlet edge of a turbine blade, which is exposed to locally high temperature stresses. In the case of film cooling, cooling air is guided from inside the turbine blade outwards via holes in the turbine blade. This cooling air flows around the turbine blade and forms an insulating layer between the hot process gas and the surface of the blade. The described types of cooling, depending upon the application case, are suitably combined in order to achieve blade cooling which is as effective as possible.

An impingement-cooled inlet edge of a turbine blade is known for example from U.S. Pat. No. 6,238,182. The turbine blade comprises a cast blade airfoil profile with a comparatively thick profile wall in which a thin-walled impingement-cooling insert is fitted. The impingement-cooling insert is supported via a plurality of ribs, which in case taper to a point, on ribs which lie opposite these and which in their turn are provided on the inner sides of the profile wall. The rib-pairs which are formed in this way are soldered together in this case so that these enclose chambers.

For realizing a convection cooling, in the case of currently known designs of turbine blades, the blade including a shell, for example in the form of a blade jacket, and cooling passages, is cast. Additional coatings are applied by means of coating processes. In this case, the producing of the cooling passages which are formed in known turbine blades, which is undertaken by means of a casting process, is particularly very time-consuming and cost-intensive.

In addition to a turbine blade which is produced in the casting process, it is also known from U.S. Pat. No. 2,906,495 to assemble purely convectively coolable turbine blades from a support structure and a shell. The support structure in this case is formed in a corrugated-like manner. The corrugation valleys and the corrugation peaks are either soldered to the suction side or to the pressure side of a blade airfoil profile which is formed by a shell, as a result of which a plurality of cooling passages extend linearly along the blade airfoil profile.

SUMMARY OF INVENTION

The invention is based on the object of disclosing a turbine blade with which a very effective convection cooling is possible, and which moreover can be produced simpler and more cost-effectively in comparison to known turbine blades.

This object is achieved according to the invention with a turbine blade according to the claims, in which the shell is spot-connected to the support structure by means of spacing elements in each case and in which the spacing elements are arranged in a planar distributed manner.

In the case of the turbine blade according to the invention, the shell, preferably in the form of a blade jacket, is used only for the transmission of aerodynamic forces via the spacing elements according to the invention to a planar support structure which lies beneath it when the turbine blade is exposed to circumflow or onflow. The support structure essentially supports the shell and absorbs the flow forces which are transmitted via the shell and via the spacing elements. If the turbine blade according to the invention is also used as a rotor blade, the support structure also absorbs the centrifugal force action as a result of rotation. In this respect the invention differs from the already known turbine blade of U.S. Pat. No. 6,238,182 in which only the blade airfoil profile itself is formed with supporting action and the insert exclusively undertakes a space-maintaining function for the impingement cooling.

The transmission of forces is carried out via the multiplicity of planar-arranged spacing elements which in each case spot-connect the shell to the support structure. As a result of the planar arrangement of the spacing elements the shell can be supported at a multiplicity of points, which enables a particularly thin and therefore particularly easily coolable shell.

The space which is formed as a result of the spacing is exposable according to the invention to throughflow with a cooling medium, preferably in the form of a gas or liquid, in order to achieve effective cooling of the shell by means of convection cooling when the turbine blade is in use. Heat energy of the shell is simply transferred according to the invention into the support structure via the spacing elements. This has the advantage that excessive heating of the support structure as a result of heating of the shell is avoided according to the invention.

By means of the turbine blade according to the invention a better separation of the tasks comprising flow deflection and transmission of forces can be provided compared with known solutions, so that the complexity of the tasks is reduced. As a result of the thermal and mechanical decoupling, it becomes possible to also effectively combine abnormal material combinations, which, in the case of known turbine blades which including shell and cooling passages are cast, is simply not easily possible.

In particular, the turbine blade according to the invention can be produced in a simpler manner in comparison to known turbine blades since an expensively designed casting mold does not have to be correspondingly provided for forming cooling passages. It is only necessary, via the spacing elements according to the invention, to create a connection between the support structure and the shell in order to form a cooling passage, which is exposable to throughflow, in the form of a space according to the invention.

According to the invention, a turbine blade which is designed for convection cooling is provided, which in addition to a simple production especially also has the advantage of a significant improvement of the heat dissipation and heat transfer to the cooling medium by means of the multiplicity of the planar-arranged spacing elements, over the surface of which the cooling medium flows and at the same time can be swirled in the process for increasing the heat transfer coefficient.

The spacing elements are especially preferably uniformly distributed between shell and support structure. In a further advantageous development of the invention, the spacing elements are formed in each case in the form of a soldering globule, which by soldering, especially surface-soldering, are connected to the support structure and the shell. According to the invention, a connection of the shell to the support structure is therefore carried out by soldering, specifically preferably at individual points. The solder according to the invention consists of small solder globules which during the soldering process do not completely melt but only partially melt. These solder globules are frequently referred to in electrical engineering by the term "ball-grid". In this way, a space in the form of a narrow gap can be formed between the shell and the support structure, wherein heat can be transferred to the support structure only at the thus-formed soldering points. The soldering globules form a large surface according to the invention so that heat can be transmitted directly to the cooling medium which flows through the space. As the number of spacing elements increases per area unit, the surface of the spacing elements over which cooling medium can flow is also altogether increased, which on the one hand improves cooling and on the other hand improves the connection of the shell to the support structure. The improved connection in its turn again enables a more rigid and thinner shell.

In a further advantageous development, the space between shell and planar support structure is formed like a gap, wherein this gap, as seen in cross section from flow inlet edge to flow trailing edge, has an essentially constant gap dimension. As a result of this, a particularly low-loss exposure to throughflow of the space with cooling air can especially be achieved for convective cooling of the shell.

In a further advantageous development, the turbine blade has a blade root which is formed in such a way that the space, starting from the blade root, is exposable to throughflow with cooling medium. Thus, exposure of the space according to the invention to throughflow can be provided in a practical way.

The invention furthermore refers to a method for producing a turbine blade according to the invention which has a support structure and a shell which encases the support structure and which is connected to the support structure in spaced-apart manner, wherein the shell is surface-soldered onto the support structure at least one point of the support structure in order to connect the shell to the support structure in a spaced-apart manner, wherein the shell is spot-connected to the support structure by means of the spacing elements and the spacing elements are arranged in a planar distributed manner.

BRIEF DESCRIPTION OF THE DRAWINGS

An exemplary embodiment of a turbine blade according to the invention is subsequently explained in more detail with reference to the attached schematic drawings, wherein.

DETAILED DESCRIPTION OF INVENTION

Figure 1:
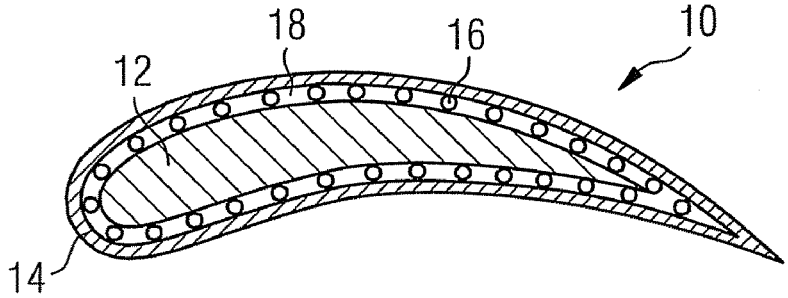
FIG. 1 shows a sectional view of a turbine blade according to the invention.

FIG. 1 shows a sectional view of a turbine blade 10 according to the invention with a flow inlet edge, which is rounded in cross section, and a pointed flow trailing edge. The turbine blade 10 comprises a solid or hollow support structure 12, and a shell in the form of a thin-walled blade jacket 14 which is connected to the support structure 12 in a spaced-apart manner by means of soldering globules 16 in order to form a space 18 in the form of a narrow gap which is exposable to throughflow by a cooling medium. For forming a gap with constant dimensions, the support structure 12 is formed in a planar manner in the region which lies opposite the shell 14 on the inside and in this case is curved corresponding to the aerodynamically profiled shape of the shell 14. The blade jacket 14 serves for transmitting aerodynamic forces, which are formed during exposure of the blade jacket 14 to onflow, to the support structure 12. The support structure 12 is formed in such a way that it can transfer the transmitted forces to a blade carrier, which is not additionally shown, upon which the support structure 12 is fastened. The connection via the multiplicity of soldering globules 16, which in everyday jargon of electrical engineering is also referred to as "ball-grid", is carried out by corresponding surface-soldering at individual points of the support structure 12 or of the blade jacket 14, wherein the soldering globules 16 do not completely melt during the soldering process.

During exposure of the space 18 to throughflow with a cooling medium, the blade jacket 14 can be effectively convectively cooled by heat energy of the blade jacket 14 being dissipated via the flowing cooling medium. Since a heat transfer between the blade jacket 14 and the support structure 12 can be carried out only via the soldering globules 16, the support structure 12 is only slightly heated as a result of a heated blade jacket 14. The largest part of the heat energy of the blade jacket 14 is dissipated via the cooling medium, wherein the soldering globules 16 form a large surface which transmits the heat energy directly to the cooling medium.

Figure 2:
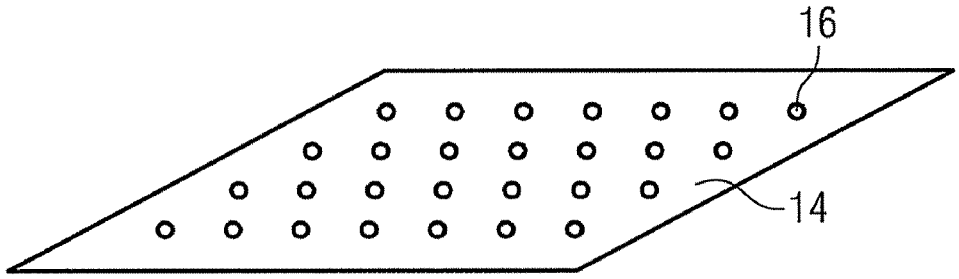
FIG. 2 shows a perspective partial view of a shell of the turbine blade in the form of a blade jacket together with connecting solder globules.

FIG. 2 shows a shell of the turbine blade 10 in the form of a blade jacket 14 together with the connecting soldering globules 16. As is apparent, the soldering globules 16 are provided only at individual points which are spaced apart from each other in order to provide a connection which is effective as possible between the support structure 12 and the blade jacket 14, specifically accompanied by a space 18 which is formed as favorable to flow as possible. The soldering globules 16 are arranged in a planar manner in the style of a uniform grid between the shell 14 and the support structure 12, as a result of which a uniform force introduction of the flow forces, which act upon the shell 14, into the support structure 12 can be carried out. At the same time, as a result of using a multiplicity of soldering globules 16 the forces which are to be transmitted by each individual soldering globule 16 can be comparatively low.

Figure 3:
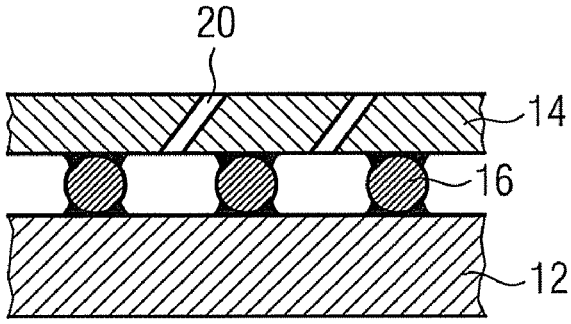
FIG. 3 shows an enlarged sectional view of a connection between shell and support structure by means of soldering globules according to the invention.

FIG. 3 finally shows an enlarged sectional view of a connection between the blade jacket 14 and the support structure 12 by means of soldering globules 16, wherein the blade jacket 14 furthermore has through-holes 20 which in addition to the convection cooling serve for providing a film cooling in such a way that cooling medium can flow outwards via the through-holes 20.

It is equally possible to achieve an impingement cooling of the blade jacket 14 with a hollow support structure 12, wherein the cavity which exists inside the support structure 12 is in communication with the space 18 via suitable impingement cooling holes.

The invention claimed is:

1. A turbine blade, comprising:

a support structure:

a plurality of spacing elements; and a shell which encases the support structure and is connected to the support structure using the plurality of spacing elements in a spaced-apart manner, wherein the plurality of spacing elements are used in order to form a space between the support structure and the shell, wherein the space is exposed to a throughflow of a cooling medium, wherein the shell is spot-connected to the support structure using the plurality of spacing elements, and wherein the plurality of spacing elements are arranged in a distributed manner, wherein each spacing element is formed as a soldering globule which is connected by soldering the spacing element to the support structure and to the shell.

2. The turbine blade as claimed in claim 1, wherein the distribution of the plurality of spacing elements is uniform.

3. The turbine blade as claimed in claim 1, wherein the soldering globule is partially melted.

4. The turbine blade as claimed in claim 1, wherein the space is formed as a gap and, as seen in a cross section from a flow inlet edge to a flow trailing edge, has an essentially constant gap dimension.

5. The turbine blade as claimed in claim 1, wherein the turbine blade is used as a rotor blade.

6. The turbine blade as claimed in claim 1, wherein the shell includes a plurality of through-holes.

7. A method for producing a turbine blade, comprising:

providing the turbine blade including a support structure and a shell, the shell encases the support structure and is connected to the support structure in a spaced-apart manner; and surface-soldering the shell onto the support structure at a plurality of points on the support structure in order to connect the shell to the support structure in the spaced-apart manner, wherein the shell is spot-connected to the support structure using a plurality of spacing elements, wherein the plurality of spacing elements are arranged in a distributed manner, and wherein the plurality of spacing elements comprise a plurality of soldering globules which are partially melted when connecting the support structure to the shell.

8. The method as claimed in claim 7, wherein the distribution of the plurality of spacing elements is uniform.

9. The method as claimed in claim 7, wherein a space is formed as a gap and, as seen in a cross section from a flow inlet edge to a flow trailing edge, has an essentially constant gap dimension.

* * * * *